United States Patent [19]

deVries

[11] Patent Number: 4,457,214

[45] Date of Patent: Jul. 3, 1984

[54] REFRIGERATED STRUCTURE

[75] Inventor: Egbert deVries, Kettering, Ohio

[73] Assignee: Quad Environmental Technologies Corporation, Highland Park, Ill.

[21] Appl. No.: 447,638

[22] Filed: Dec. 7, 1982

[51] Int. Cl.[3] ..... B64D 13/00; F24F 7/00; F25D 25/00

[52] U.S. Cl. ..... 98/1.5; 62/273; 98/31

[58] Field of Search ..... 98/1.5, 31, 33 A; 62/273, 405, 186

[56] References Cited

U.S. PATENT DOCUMENTS

| | | | |
|---|---|---|---|
| 1,947,223 | 2/1934 | Ophuls | 62/186 X |
| 2,151,713 | 3/1939 | Niemann | 62/273 X |
| 3,818,813 | 6/1974 | Freeman | 98/33 A |

*Primary Examiner*—William E. Wayner
*Assistant Examiner*—J. Sollecito
*Attorney, Agent, or Firm*—Fidelman, Wolffe and Waldron

[57] ABSTRACT

The insulated walls of a refrigerator chamber are pressurized so as to maintain a pressure within the insulated interior of the walls that is slightly higher than the exterior ambient air pressure. This is accomplished by means of small fans or the like blowing outwardly and mounted on the interior of the walls.

2 Claims, 1 Drawing Figure

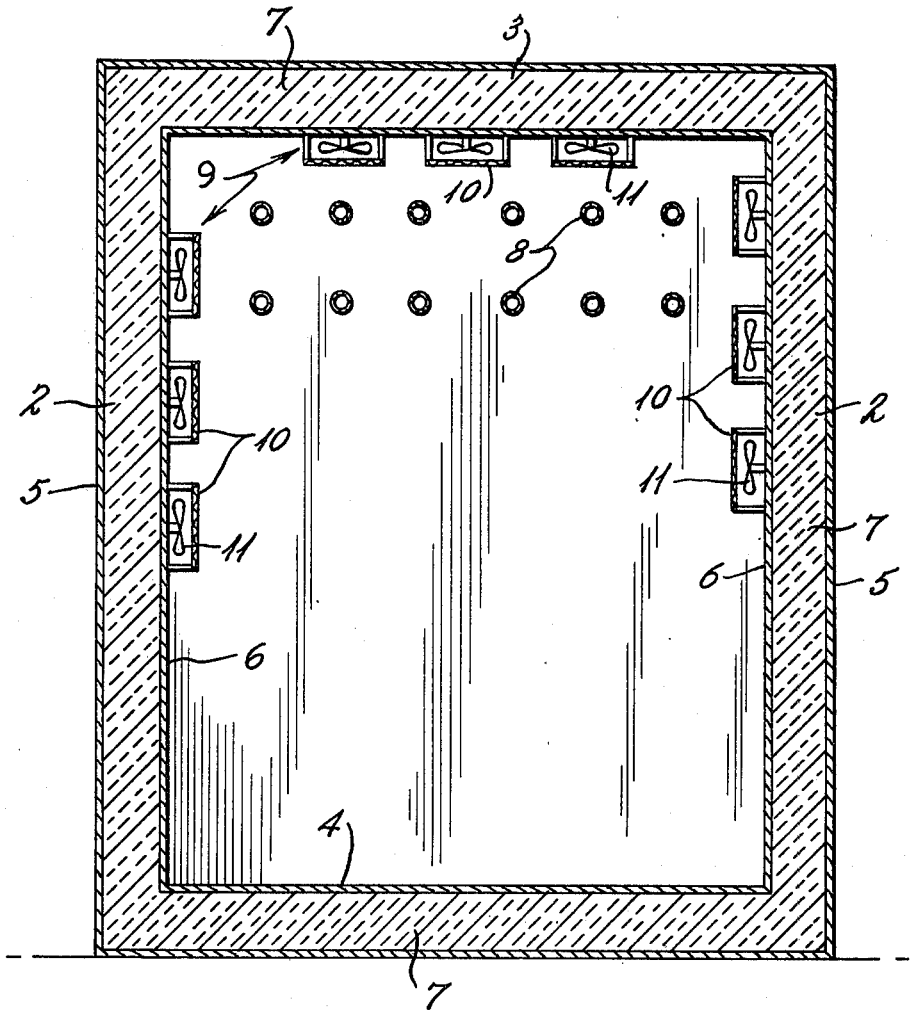
7
3
9
10
11
8
2
10
5
11
6
10
2
11
7
6
5
4
7

REFRIGERATED STRUCTURE

BACKGROUND OF THE INVENTION

1. Field of the Invention:

This invention relates to refrigeration chambers, and more particularly to means for preventing moisture condensation within the insulation material in the wall structures of said chambers.

2. Description of the Prior Art:

Air movement through the insulated walls of a refrigeration building or chamber is a well-recognized phenomenon and is considered to be due to the fact that cold air, having a greater density than warm air, sinks to the bottom of the chamber, resulting in a higher pressure at the lower portion than the outside air pressure. At the top of the chamber, the pressure is less than the outside air pressure. Accordingly, air tends to flow through the insulated walls and ceiling into the chamber at the upper portion and flow outward at the lower portion. Inward flow of warm ambient air is harmful in that moisture condenses within walls and causes deterioration of insulation and wall structure.

A number of proposals by others have been made to eliminate this problem. Illustrative are the U.S. Pat. Nos. 1,947,223 to Ophuls; 2,151,713 to Niemann; 2,244,005 to Gustin, Jr., et al,; and 2,485,630 to Munters.

It has been proposed by Ophuls, U.S. Pat. No. 1,947,223 to avoid these problems by maintaining the pressure within the entire refrigerated building somewhat higher than the external pressure, whereby cold air would flow outwardly through the walls. He also suggests a false wall around the entire insulating wall structure with a space therebetween and maintaining a subatmospheric pressure in the intermediate space. This solution involves extensive structural additions with attendant increases in cost. Additionally, inwardly swinging doors would be difficult to open against the increased air pressure, and considerable refrigerated air would rush out each time a door is opened. Replacement air would have to be refrigerated.

Nieman—U.S. Pat. No. 2,151,713 cools atmospheric air and injects the cooled air into the interior insulation of the refrigerator walls.

Gustin, Jr., et al.—U.S. Pat. No. 2,244,005 provides a ventilation system for the insulation.

Munters—U.S. Pat. No. 2,485,630 shows passing cold dried air through the insulation.

None of these patents employs the simple means of this invention to solve this vexatious problem.

In De Vries U.S. Pat. No. 3,965,698, which is hereby incorporated by reference, the crawl space above the ceiling of a refrigerated building is maintained at a negative pressure, whereby the flow of ambient air into the upper part of the said building is prevented. While effective, this may entail costly structural changes to create the necessary space for the negative air pressure system.

In contrast to the above, in this invention the upper wall region and ceiling are pressurized by a relatively simple means of local effectiveness so that no excessive amount of cold air escapes on opening the door, and no excessive air pressure renders opening an inwardly swinging door difficult.

SUMMARY OF THE INVENTION

This invention consists of forcing air through the upper portions of the wall and ceiling of a refrigeration chamber, from the inside to the outside, by a plurality of means such as fans or the like in order to pressurize these upper wall and ceiling areas and prevent the inflow of ambient outside air into the said areas.

BRIEF DESCRIPTION OF THE DRAWING

The FIGURE is a schematic view in section of a refrigerated chamber according to the invention.

DESCRIPTION OF THE INVENTION

In the FIGURE, reference numeral 1 represents a conventional refrigeration chamber consisting of walls 2,2, ceiling 3 and floor 4. The walls, floor and ceiling are all insulated and in the embodiment shown consist of an outer and inner sheath or covering 5 and 6 having insulating material 7 therebetween. A vapor barrier (not shown) is located between the insulation 7 and outer sheath or covering 5. The covering 5 and 6 may be any suitable structural material, such as sheet metal, wood or plastic; the vapor barrier may be sheet plastic such as polyethylene and the insulating material may be Fiberglas or the like. Refrigeration coils 8 connected to refrigeration equipment (not shown) maintain the temperature within the chamber at a desired figure.

To counter the effect of the negative pressures in the upper portion of the refrigeration chamber, a plurality of electric fans 9 are mounted on the ceiling and upper portion of the walls. Fan 9 has a guard 10, which conveniently may be wire mesh, revolving fan blade 11, and is connected to an electric power source. The fans are relatively small, for example, 3 to 8 inches in diameter and their spacing depends on the refrigerator height and temperature. At the fan location, the walls and ceiling must have sufficient porosity to allow air from the fan to penetrate the adjacent insulation and pressurize it. With normally impervious materials such as sheet metal or plastic, the area directly under the fan is perforated sufficiently to allow the pressurized air to pass through.

As is obvious to the art, the fans may be controlled manually, or automatically by a switch sensing the pressure difference between the inside of the chamber and the ambient air. Additionally, the fans may be wired so as to be switched on and off individually. Thus, when the pressure conditions inside the chamber warrant, at least some of the fans may be turned off.

The pressure difference between the outside and ceiling air pressures may be expressed mathematically as follows:

$$\Delta P = 7.55\left(\frac{1}{460 + t_r} - \frac{1}{460 + t_o}\right) \times \frac{H}{2},$$

wherein $\Delta P$=the pressure difference in inches of water between the outside and the ceiling air pressures;

$t_r$=refrigerated temperature in °F.;

$t_o$=outside temperature in °F.; and

H=ceiling height

At about the mid-height of the wall the inner and outer air pressures are equal. Accordingly, the fans are located in the upper half of the wall, and in the ceiling.

While bladed fans have been shown as the pressurizing means, other means may be employed, such as reciprocating air pumps, centrifugal air pumps, etc., as will be apparent to those skilled in the art.

What is claimed:

1. A refrigerated chamber comprising:

sidewall, ceiling and floor structures, said structures having inner and outer surfaces with insulating material therebetween;

a plurality of air pressurizing means mounted on the interior surface of said ceiling structure and the upper portions of said sidewall structures, at least one of said ceiling and sidewall structures having sufficient porosity at the location of said air pressurizing means to allow air from said pressurizing means to penetrate and pressurize said insulation, each of said air pressurizing means capable of delivering air flow and being mounted so as to force refrigerated air towards said ceiling and said upper portions of said sidewalls, whereby on operating said air pressurizing means, the air pressure within said insulation of said sidewalls and said ceilings is rendered greater than the ambient air pressure.

2. The refrigerated chamber of claim 1, wherein the air pressurizing means consists of fans having revolving blades.

* * * * *